US010427423B2

(12) United States Patent
Nagasu et al.

(10) Patent No.: US 10,427,423 B2
(45) Date of Patent: Oct. 1, 2019

(54) RECORDING DEVICE DISCHARGE POSITION ADJUSTOR AND IMAGE FORMING APPARATUS INCORPORATING SAME

(71) Applicants: Tsuyoshi Nagasu, Kanagawa (JP); Takahiro Inoue, Kanagawa (JP); Tomoaki Hayashi, Tokyo (JP)

(72) Inventors: Tsuyoshi Nagasu, Kanagawa (JP); Takahiro Inoue, Kanagawa (JP); Tomoaki Hayashi, Tokyo (JP)

(73) Assignee: Richoh Company, Ltd., Tokyo (JP)

( * ) Notice: Subject to any disclaimer, the term of this patent is extended or adjusted under 35 U.S.C. 154(b) by 25 days.

(21) Appl. No.: 14/876,350

(22) Filed: Oct. 6, 2015

(65) Prior Publication Data

US 2016/0121602 A1 May 5, 2016

(30) Foreign Application Priority Data

Oct. 29, 2014 (JP) ..... 2014-220712

(51) Int. Cl.
*B41J 11/00* (2006.01)
*B41J 29/38* (2006.01)
(Continued)

(52) U.S. Cl.
CPC ..... *B41J 11/0095* (2013.01); *B41J 2/2135* (2013.01); *B41J 2/2146* (2013.01); *B41J 11/008* (2013.01); *B41J 25/001* (2013.01)

(58) Field of Classification Search
CPC .... B41J 11/0095; B41J 11/008; B41J 25/001; B41J 2/2146; B41J 2/2135; B41J 29/38; B41J 2/045
See application file for complete search history.

(56) References Cited

U.S. PATENT DOCUMENTS 6,172,688 B1 1/2001 Iwasaki et al.
7,630,657 B2 * 12/2009 Ehara ..... G03G 15/0131 399/301
(Continued)

FOREIGN PATENT DOCUMENTS

JP 07047747 A * 2/1995
JP H 07-47747 A 2/1995
(Continued)

OTHER PUBLICATIONS

Japanese Office Action, with the Dispatch No. 201147, dated May 18, 2018 for Japanese Patent Application No. 2014-220712.

*Primary Examiner* — Julian D Huffman
*Assistant Examiner* — Michael Konczal
(74) *Attorney, Agent, or Firm* — Harness, Dickey & Pierce, P.L.C.

(57) ABSTRACT

A recording device discharge position adjustor includes a recording device to discharge liquid droplets onto a recording medium; an edge detector unit to detect a lateral edge position of the recording medium in a direction perpendicular to a recording medium conveyance direction; a discharge position adjustor to adjust a discharge position of the liquid droplets from the recording device relative to the recording medium; a controller to adjust the discharge position using the discharge position adjustor; and an edge position converter to convert the edge position of the recording medium detected by the edge detector unit to an edge position at a position of the recording device, in which the controller adjusts the discharge position of the recording device by an adjustment amount corresponding to the edge position of the recording medium at the position of the recording device converted by the edge position converter.

11 Claims, 7 Drawing Sheets

(51) Int. Cl.
*B41J 2/21* (2006.01)
*B41J 25/00* (2006.01)

(56) References Cited

U.S. PATENT DOCUMENTS

| | | | | |
|---|---|---|---|---|
| 8,172,357 | B2 * | 5/2012 | Enomoto | B41J 3/543 347/16 |
| 9,227,439 | B1 * | 1/2016 | Katerberg | B41J 11/0095 |
| 2010/0079525 | A1 * | 4/2010 | Suzuki | B41J 11/46 347/14 |
| 2011/0273502 | A1 * | 11/2011 | Eun | B41J 2/17593 347/14 |
| 2015/0009262 | A1 * | 1/2015 | Bell | B41J 15/046 347/37 |

FOREIGN PATENT DOCUMENTS

| | | | | |
|---|---|---|---|---|
| JP | 2011-046173 | | | 3/2011 |
| JP | 2011-079214 | A | | 4/2011 |
| JP | 2011079214 | A | * | 4/2011 |
| JP | 2011-126204 | A | | 6/2011 |
| JP | 2011126204 | A | * | 6/2011 |
| JP | 2011-136526 | | | 7/2011 |
| JP | 2015-013476 | | | 1/2015 |

* cited by examiner

RECORDING DEVICE DISCHARGE POSITION ADJUSTOR AND IMAGE FORMING APPARATUS INCORPORATING SAME

CROSS-REFERENCE TO RELATED APPLICATION

The present application claims priority pursuant to 35 U.S.C. § 119(a) from Japanese patent application number 2014-220712 filed on Oct. 29, 2014, the entire disclosure of which is incorporated by reference herein.

BACKGROUND

Technical Field

The present invention relates to a recording device discharge position adjustor and an image forming apparatus incorporating the adjustor.

Background Art

Image forming apparatuses employing an inkjet method are known, in which a plurality of recording devices discharges liquid droplets of a plurality of colors, respectively, onto a recording medium, such as a sheet of paper, and the discharged colors are superimposed on the recording medium, thereby forming a full-color image on the recording medium.

The image forming apparatus as described above includes a first head unit as a recording device to discharge liquid droplets of an ink liquid onto the sheet and a second head unit disposed downstream of the first head unit in a sheet conveyance direction, with both head units disposed along the sheet conveyance direction. A head unit displacer can move the second head unit laterally in a direction perpendicular to the sheet conveyance direction. Edge sensors to detect the lateral edge of the sheet are disposed upstream of the first head unit and the second head unit. When the sheet skews while being conveyed, the second head unit is displaced laterally by a displacement amount based on an output from each edge sensor, so that a relative positional error of the discharge position of the second head unit to the sheet relative to the discharge position of the first head unit to the sheet is corrected.

However, because the edge sensors are disposed upstream of each head unit in the sheet conveyance direction, they cannot directly detect an edge position of the sheet at a position of the head unit. Due to a change of the edge position sideways caused by skew/wobbling of the sheet, the edge positions of the sheet of recording medium at the edge sensor and at the head unit are not the same but are instead offset laterally.

SUMMARY

In one embodiment of the disclosure, provided is an optimal recording device discharge position adjustor including a recording device to discharge liquid droplets onto a recording medium; an edge detector unit to detect a lateral edge position of the recording medium in a direction perpendicular to a recording medium conveyance direction; a discharge position adjustor to adjust a discharge position of the liquid droplets from the recording device relative to the recording medium; a controller to adjust the discharge position using the discharge position adjustor; and an edge position converter to convert the edge position of the recording medium detected by the edge detector unit to an edge position at a position of the recording device, in which the controller adjusts the discharge position of the recording device by an adjustment amount corresponding to the edge position of the recording medium at the position of the recording device converted by the edge position converter.

In another embodiment of the disclosure, provided is an optimal image forming apparatus including a plurality of recording devices to discharge liquid droplets onto a recording medium to record an image on the recording medium, disposed along a recording medium conveyance direction; a plurality of edge detectors to detect a lateral edge position of the recording medium in a direction perpendicular to the recording medium conveyance direction; a discharge position adjustor to adjust a discharge position of the liquid droplets relative to the recording medium, from at least one of the recording devices; and the above optimal recording device discharge position adjustor.

These and other objects, features, and advantages of the present invention will become apparent upon consideration of the following description of the preferred embodiments of the present invention when taken in conjunction with the accompanying drawings.

DETAILED DESCRIPTION

Figure 2:
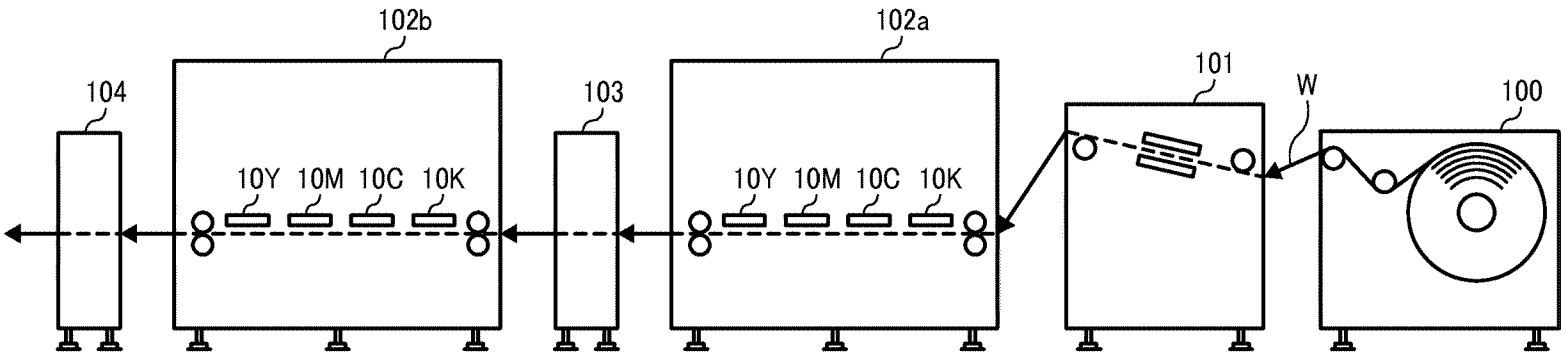
FIG. 2 schematically illustrates an image forming system according to an embodiment of the present invention.

FIG. 2 schematically illustrates an image forming system according to an embodiment of the present invention. As illustrated in FIG. 2, a sheet W as a recorded medium such as a one long sheet rolled out from a sheet feeder 100 is first fed into a treatment liquid coating device 101, which applies a treatment liquid to both sides of the sheet W in a pretreatment process. Next, the sheet W that has been subject to the pretreatment process by the treatment liquid coating device 101, is fed into a first inkjet printer 102*a*, so that the sheet W is conveyed by a plurality of rollers, receives ink droplets on its front surface thereof from line head units 10 disposed at plural positions, and a desired image is formed thereon. Thereafter, the sheet W is reversed by a reversing device 103. The reversed sheet W is fed into a second inkjet printer 102*b*, so that the sheet W is conveyed by a plurality of rollers, receives ink droplets on its back surface thereof from the plural line head units 10, and a desired image is formed thereon. Thus, after the image is formed on both sides of the sheet W, the sheet W is sent to a post-treatment device 104 for a predetermined post-treatment.

Figure 1:
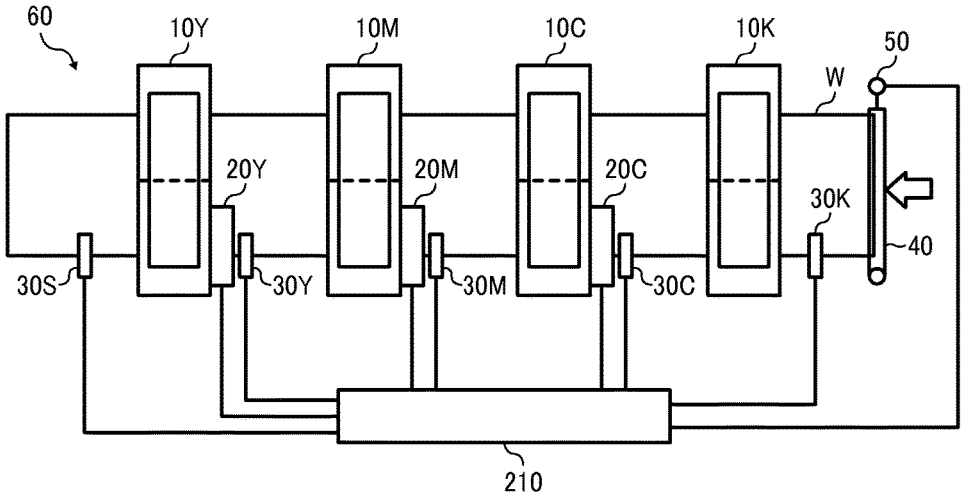
FIG. 1 schematically illustrates a line head unit position correction device, in plan view, included in a first inkjet printer.

FIG. 1 schematically illustrates a line head unit position correction device 60, in plan view, included in the first inkjet printer 102*a*. Similarly, the line head unit position correction device 60 is also included in the second inkjet printer 102*b*, and redundant description thereof will be omitted.

The first inkjet printer 102*a* includes a feed roller 40 to feed the sheet W, and an encoder 50 mounted on the feed roller 40 that detects a feed amount of the sheet W based on a rotation amount of the feed roller 40. In addition, the first inkjet printer 102*a* includes line head units 10K, 10C, 10M, and 10Y disposed along a sheet conveyance direction that discharge ink droplets of black (K), cyan (C), magenta (M), and yellow (Y), respectively, to a front surface of the sheet W that has been fed by the feed roller 40. Each of the line head units 10C, 10M, and 10Y other than the line head unit 10K is provided with an actuator 20C, 20M, or 20Y, to move each of the line head units 10C, 10M, and 10Y in a widthwise direction perpendicular to the sheet conveyance direction. Further, each edge sensor 30K, 30C, 30M, or 30Y is disposed upstream of the line head unit 10K, 10C, 10M, or 10Y in the sheet conveyance direction and detects an edge position of the sheet W. The edge sensors may be referred to as an edge sensor unit when used in combination such as an upstream edge sensor and a downstream edge sensor.

Figure 3:
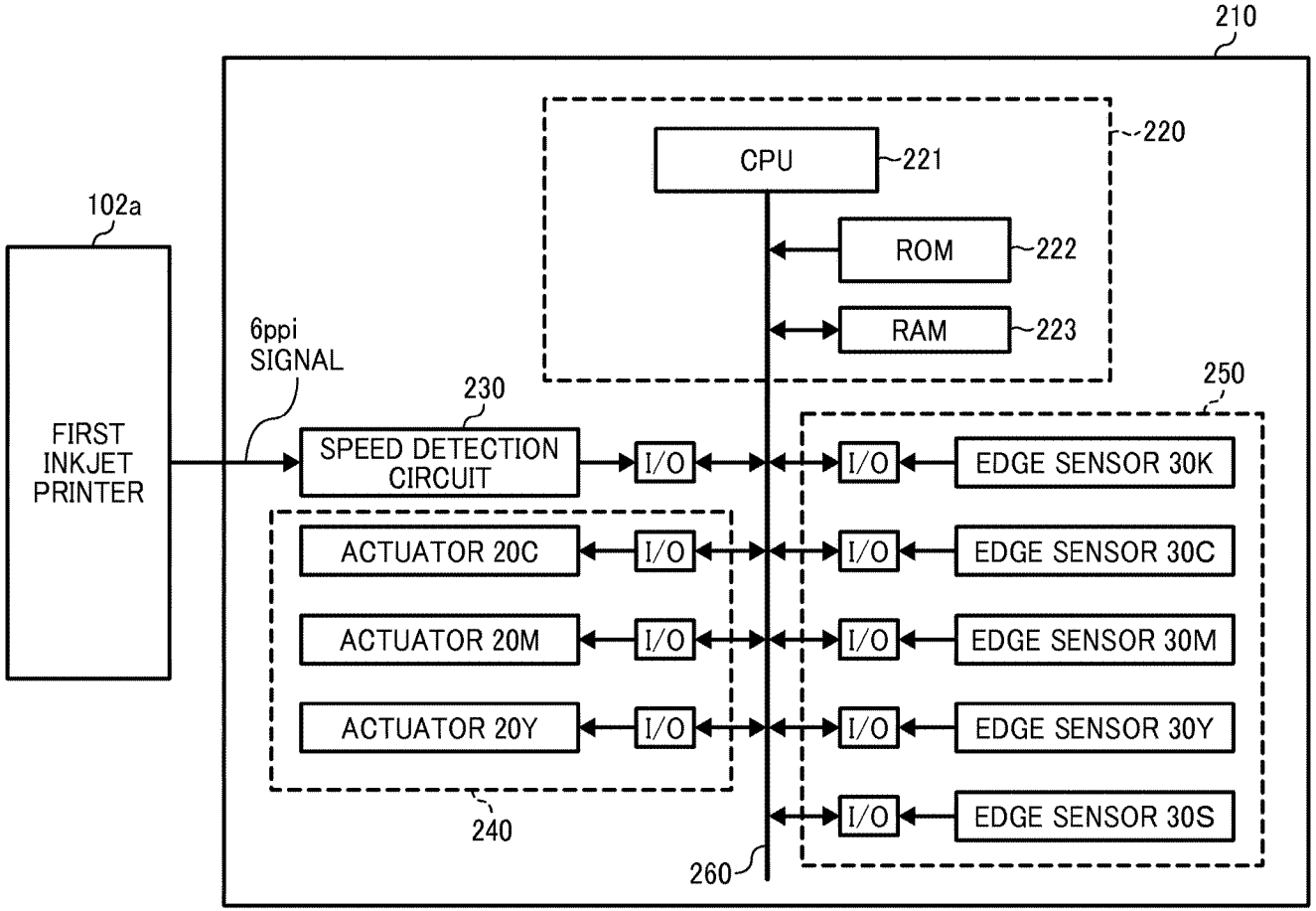
FIG. 3 is a block diagram illustrating an exemplary configuration of a controller for controlling the line head unit position correction device.

FIG. 3 is a block diagram illustrating an exemplary configuration of a controller for controlling the line head unit position correction device 60. The line head unit position correction device 60 to correct each position of the line head units 10 laterally includes a controller section 210. The controller section 210 includes a microprocessor 220, a speed detection circuit 230, an actuator controller 240, and a sensor controller 250, and a bus 260. The speed detection circuit 230, the actuator controller 240, the sensor controller 250 are each connected to the microprocessor 220 via the bus 260.

The speed detection circuit 230 detects a speed of feeding the sheet W based on a sheet feed synchronization signal output from the encoder 50 that detects the sheet feed speed. The microprocessor 220 includes a CPU 221, a ROM 222, a RAM 223, and the like. The CPU 221 performs operations necessary for correcting positions of the line head units, the ROM stores various programs that the CPU 221 performs, and the RAM 223 temporarily stores operations results, and the like.

Figure 4A:
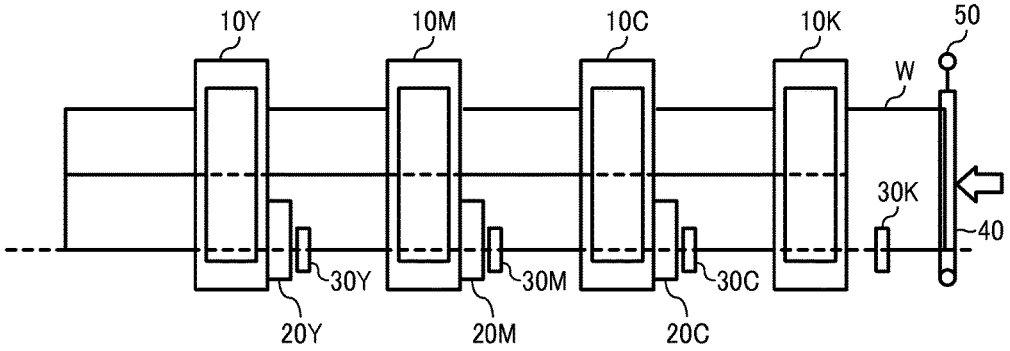
FIGS. 4A and 4B schematically illustrate a comparative example of a line head unit position correction device.
Figure 4B:
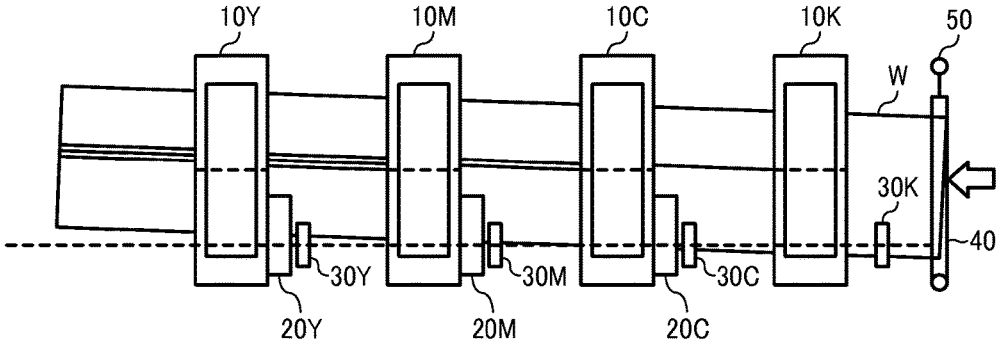

FIGS. 4A and 4B schematically illustrate a comparative example of a line head unit position correction device. The line head unit position correction device illustrated in FIG. 4A and FIG. 4B first obtains a difference between an output value of the edge sensor 30K detected when the sheet W conveyed by the feed roller 40 passes through a position of the edge sensor 30K, and a preset reference value r1 for the edge sensor 30K. The obtained difference is set as a positional error d1.

Next, a conveyance amount of the sheet W between the edge sensor 30K and the edge sensor 30C is measured using the encoder 50 mounted on the feed roller 40, so as to detect a same position of the sheet W. Specifically, a difference between an output value of the edge sensor 30C detected when a detection position of the sheet W detected by the edge sensor 30K passes the position of the edge sensor 30C, and a preset reference value r2 of the edge sensor 30C is obtained, and the obtained value is set as a positional error d2.

Thus, by obtaining the difference between the positional error d1 and the positional error d2, a relative positional error D of the sheet W in the width direction between respective positions of the line head unit 10K and the line head unit 10C can be obtained.

Then, the actuator 20C is driven based on the positional error D, and the line head unit 10C is displaced laterally, thereby correcting the position. Herein, the positional correction of the line head unit 10C alone is described; however, similarly, as to the line head units 10M and 10Y, a relative positional error can be obtained with reference to edge sensor 30K, and the positions of the line head units 10M and 10Y can be corrected.

Figure 5A:
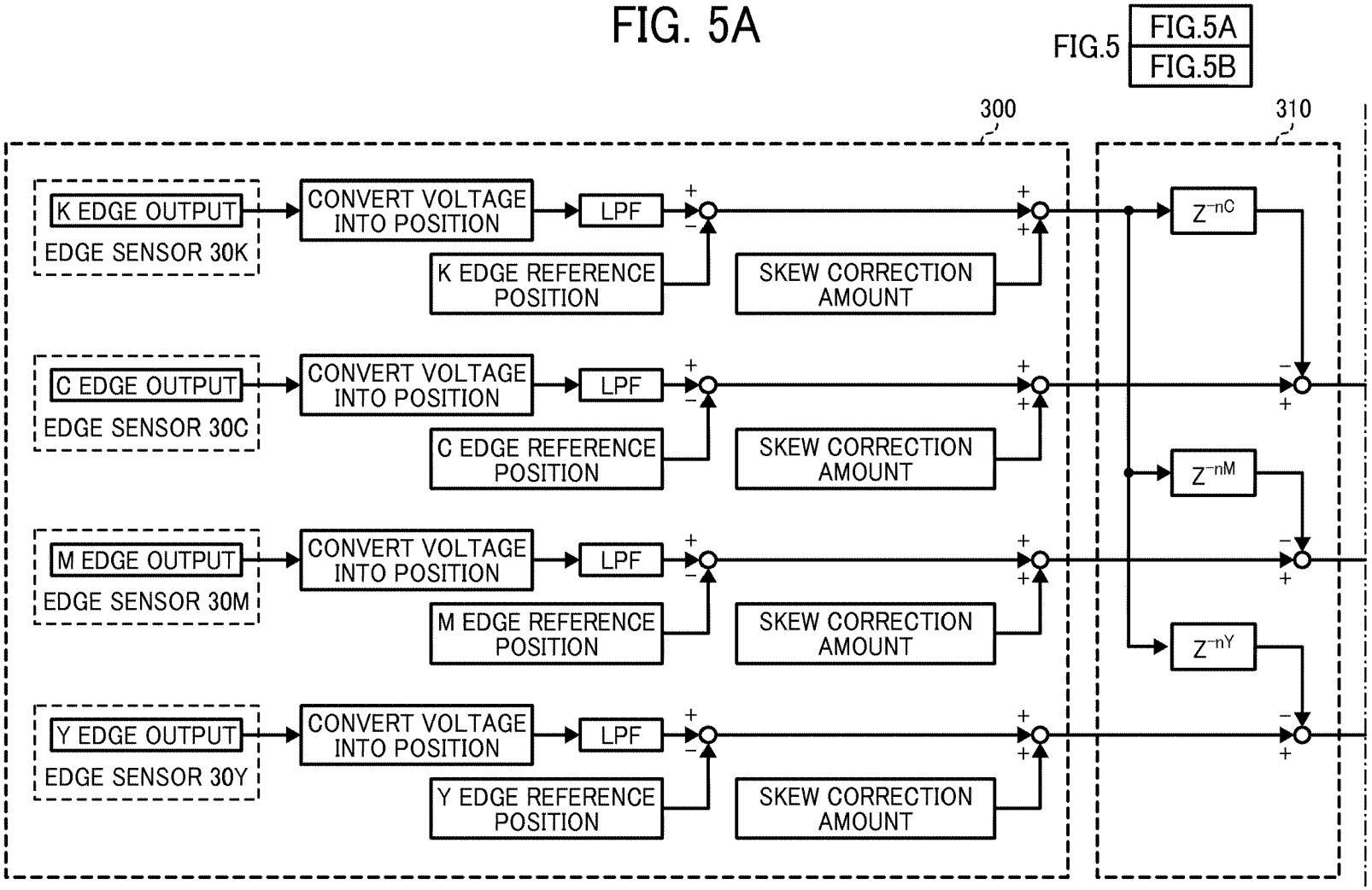
FIGS. 5A and 5B (collectively referred to as FIG. 5) are block diagrams illustrating a configuration of a controller for controlling a line head unit position correction device according to an embodiment of the present invention.
Figure 5B:
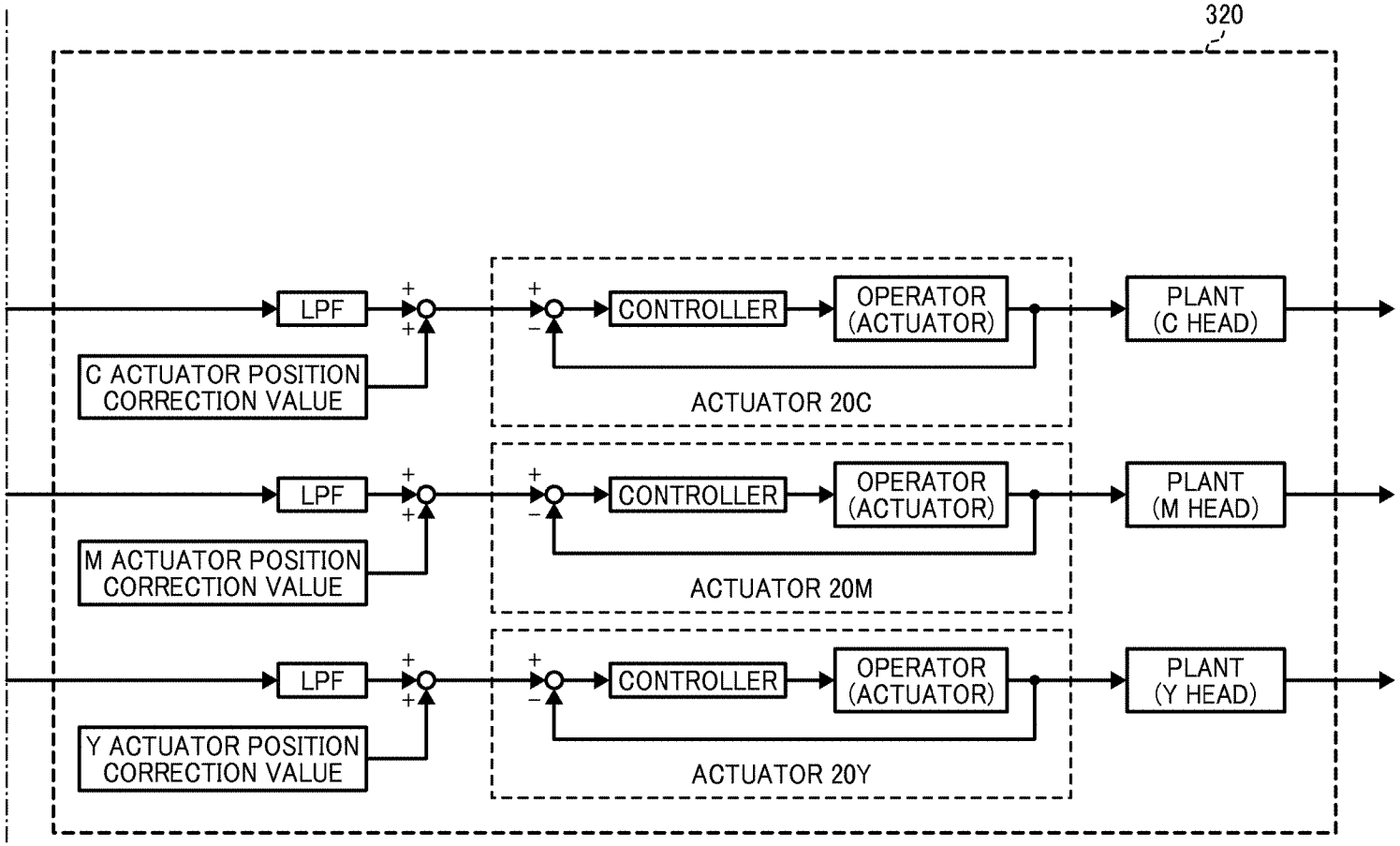

FIGS. 5A and 5B are block diagrams illustrating an exemplary configuration of a controller for controlling the line head unit position correction device 60. The above control is performed each time the sheet W is conveyed by a predetermined amount based on the conveyed amount of the sheet W obtained by using the encoder 50. Because the wobbled skew of the sheet W is proportional to the sheet feed speed, the line head unit position correction control is performed based on the conveyed amount of the sheet W, so that even with the difference in the sheet feed speed, the control is performed based on the common control and the same performance can be obtained.

The line head unit position correction control is performed by three parts: A sheet edge detector 300, a sheet wobble calculator 310, and an actuator controller 320.

First, operations performed by the sheet edge detector 300 will be described. Because each of the edge sensors 30K, 30C, 30M, and 30Y can detect an edge of the sheet W and thus performs the same operation, the edge sensor 30K is taken as representative, and only the operations performed by the sheet edge detector 300 using the edge sensor 30K will be described below.

An edge sensor output voltage from the edge sensor 30K is converted into a sheet position, and after the output voltage has been converted into the sheet position, noise is removed by a low-pass filter (LPF). The term "noise" herein means a variation in the precision of sheet preparation and vibration of the apparatus, so that the cutoff frequency of the LPF is determined by the precision of sheet preparation and the vibration of the apparatus. Thereafter, a difference from the edge reference position set in an initial adjustment when shipped from factory is obtained. The edge reference position is a corrected value from the actually mounted position of the edge sensor 30K with an error, by which the detection position of the edge sensor 30K is adjusted to zero point.

After calculating the difference from the edge reference value, a skew correction amount is added to correct a skew between the edge sensor 30K and the line head unit 10K, and the displacement amount of the sheet W at the position of the edge sensor 30K is converted to the displacement amount of the sheet W at the position of the line head unit 10, by a conversion method that will be described later with reference to FIG. 6.

Next, a calculation method of a wobbled skew between the edge sensor 30K and the edge sensor 30C performed by the sheet wobble calculator 310 will be described.

The sheet wobble calculator 310 obtains a difference between the sheet displacement amount obtained by the edge sensor 30C and the sheet displacement amount obtained by the edge sensor 30K, and the difference is assumed to be a sheet wobbled skew amount between the edge sensor 30K and the edge sensor 30C. Herein, the sheet displacement amount calculated by the edge sensor 30K by obtaining the difference from the sheet displacement amount calculated by the edge sensor C is assumed to be a past displacement amount corresponding to a distance between the edge sensor 30K and the edge sensor 30C. Further, the term "past displacement amount corresponding to the distance" means the sensor output of the edge sensor 30K detected 0.1 second earlier than the sensor output detected by the edge sensor 30C.

The edge sensor 30K and the edge sensor 30C are separated from each other in the sheet conveyance direction, the sheet W is conveyed from the edge sensor 30K to the edge sensor 30C, and the displacement amount of the sheet W between the edge sensor 30K and the edge sensor 30C is calculated by detecting the same edge position. For example, in a case in which the distance between the edge sensor 30K and the edge sensor 30C is 200 mm and the sheet conveyance speed is 2000 mm/s, the sensor output of the edge sensor 30C detected at a time t includes a difference from the amount detected by the edge sensor 30K 0.1 second (that is, 200 [mm] divided by 2000 [mm/s]) earlier.

In addition, the sheet wobbled skew amount between the edge sensor 30K and the edge sensor 30M, and the sheet wobbled skew amount between the edge sensor 30K and the edge sensor 30Y can be obtained according to the similar calculation method.

Next, operation performed by the actuator controller 320 will be described.

After calculating the sheet wobbled skew amount, noise is removed by the LPF. The term "noise" herein means frequencies related to color shift between lines and wobbling cycle, so that the cutoff frequency of the LPF is determined by the color shift between lines and wobbling cycle. Thereafter, a difference from the actuator reference value set in the initial adjustment when shipped from factory is obtained. The actuator reference position is obtained as described below and is previously stored in the memory. The actuators 20C, 20M, and 20Y moves the line head units 10C, 10M, and 10Y such that the color shift or the positional error of the longitudinal C line, M line, and Y line becomes zero generated in the same direction as that of the K line longitudinal in the sheet conveyance direction generated on the sheet W in a state in which the sheet conveyance is stable. The shifted amount of the actuators 20C, 20M, and 20Y obtained at that time is set as the actuator reference value and is previously stored in the memory.

Based on the stored value, a move command is issued to the controller, so that the controller causes the actuators 20C, 20M, and 20Y to move to a designated position. The controller sets a designated position as a target value using the Proportional-Integral-Derivative (PID) control method, and causes the encoder mounted inside each of the actuators 20C, 20M, and 20Y to adjust the position. The actuators 20C, 20M, and 20Y cause the line head units 10C, 10M, and 10Y to move, thereby enabling color adjustment of C-, M-, and Y-lines relative to the K-line.

Figure 6:
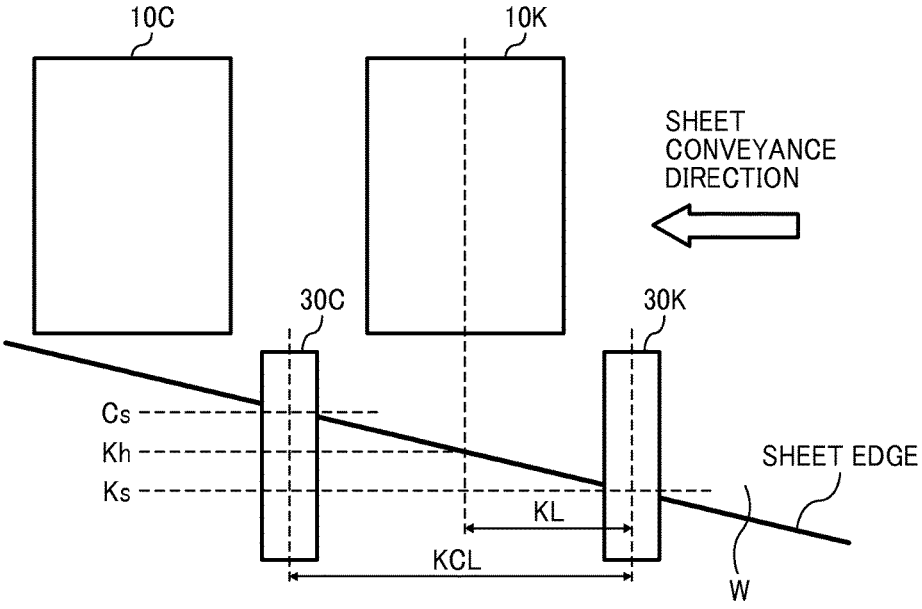
FIG. 6 illustrates a method for calculating a skew correction amount between an edge sensor 30K and a line head unit 10K.

FIG. 6 illustrates a method for calculating a skew correction amount between the edge sensor 30K and the line head unit 10K. In the present embodiment, the skew correction amount is calculated to convert the sheet edge position detected by the edge sensor 30K into a sheet edge position at the line head unit 10K.

The sheet W is conveyed in a direction indicated by an arrow in FIG. 6. When the sheet W is conveyed obliquely, a sheet edge position Ks detected by the edge sensor 30K and a sheet edge position Kh at the line head unit 10K are deviated due to an effect of skewing. Then, the difference between the sheet edge position Ks and the sheet edge position Kh will be an error when the line head position correction control is performed.

To solve the problem that the difference between the sheet edge position Ks and the sheet edge position Kh becomes an error when the line head position correction control is performed, it can be though that an edge sensor 30K is disposed at the same position as the line head unit 10K in the sheet conveyance direction. However, this approach requires the whole apparatus to be larger.

The edge position at the edge sensor 30K disposed upstream of the line head unit 10K in the sheet conveyance direction is assumed to be Ks, and the edge position at the edge sensor 30C disposed downstream of the line head unit 10K in the sheet conveyance direction is assumed to be Cs. In addition, a distance between the edge sensor 30K and the edge sensor 30C is assumed to be KCL, and a distance between the edge sensor 30K and the line head unit 10K is assumed to be KL. Then, the edge position Kh at the line head unit 10K is obtained by the following formula (1):

$$Kh=(Cs-Ks)\times(KL/KCL) \quad (1)$$

Figure 7:
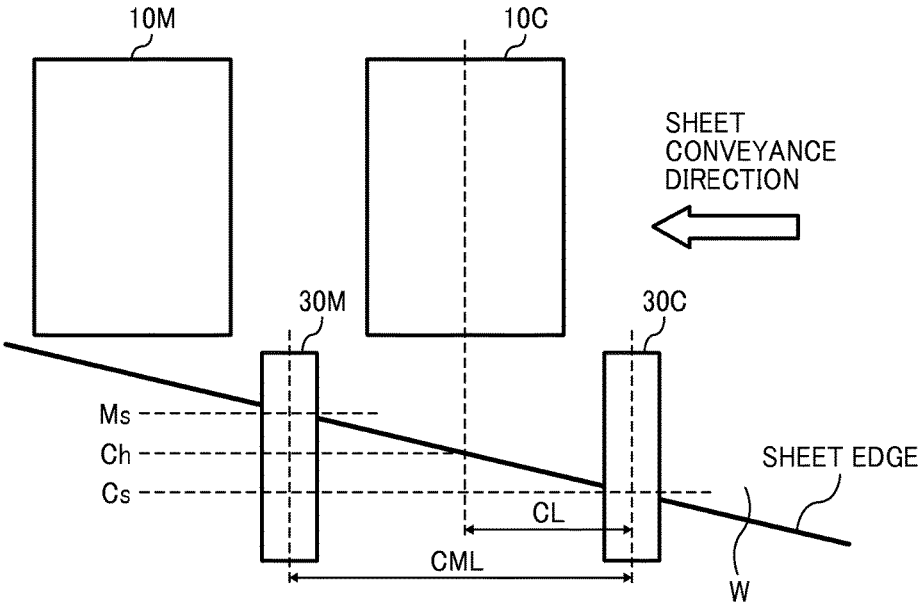
FIG. 7 illustrates the skew correction amount calculation method between an edge sensor 30C and a line head unit 10C.

Similarly, the edge position at each of the edge sensors 30C, 30M, 30Y, and 30S is converted to the edge position at each of the line head units 10C, 10M, and 10Y. As illustrated in FIG. 7, the skew correction amount calculation method will be described at a position between the edge sensor 30C and the line head unit 10C. The edge position at the edge sensor 30C disposed upstream of the line head unit 10C in the sheet conveyance direction is assumed to be Cs, and the edge position at the edge sensor 30M disposed downstream of the line head unit 10C in the sheet conveyance direction is assumed to be Ms. In addition, a distance between the edge sensor 30C and the edge sensor 30M is assumed to be CML, and a distance between the edge sensor 30C and the line head unit 10C is assumed to be CL. Then, the edge position Ch at the line head unit 10C is obtained by the following formula (2):

$$Ch=(Ms-Cs)\times(CL/CML) \quad (2)$$

Similarly, the edge position at each of the edge sensors 30K, 30C, 30M, 30Y, and 30S is converted to the edge position at each of the line head units 10K, 10C, 10M, and 10Y. As a result, error of the edge position for each color between the edge sensor 30 and the line head unit 10 can be reduced.

In the present embodiment, the position of the line head unit 10 is corrected as described above, and the line head unit 10 is displaced laterally by the actuator 20 by a displacement amount corresponding to the edge position at the position of the line head unit 10. With this structure, the line head unit 10 can be prevented from displacing laterally to a position shifted by the difference of the edge position between the position of the edge sensor 30 and the position of the line head unit 10. As a result, the line head unit 10 can be moved to a target position to discharge droplets accurately, and the discharge position to the recording medium of the line head unit 10 can be prevented from deviating from the target discharge position by the error amount laterally. As a result, the position of the line head unit 10 can be corrected more accurately, and a relative positional error of each of the line head units 10 to discharge droplets onto the sheet W can be reduced, thereby improving quality of the printout.

In the present embodiment, the line head unit 10 is shifted by the actuator 20 by the above displacement amount, so that the discharge position of the ink liquid from the line head unit 10 relative to the sheet W is adjusted; however, the structure to adjust the discharge position is not limited to this. For example, a plurality of nozzles to discharge the ink liquid is disposed along the sheet width direction on a surface of the line head unit 10 opposite the sheet W. Of the plurality of nozzles, the ink liquid is discharged from such a nozzle that positions at a position displaced laterally by an adjusted amount corresponding to the edge position of the line head unit 10, thereby adjusting the discharge position.

The aforementioned embodiments are examples and specific effects can be obtained for each of the following aspects of (A) to (F):

Aspect A:

A recording device discharge position adjustor such as a line head unit position correction device 60 includes a recording device such as a line head unit 10 that discharges liquid droplets onto a recording medium such as a sheet W and records an image on the recording medium; an edge detector unit such as an edge sensor 30 that detects an edge position of the recording medium in the recording medium width direction perpendicular to a recording medium conveyance direction; a discharge position adjustor such as an actuator 20 that adjusts discharge positions of the liquid droplets from the recording device relative to the recording medium; and a controller such as a controller section 210 that performs operation to cause the discharge position adjustor to adjust the discharge position. The device further includes an edge position converter such as a sheet edge detector 300 that converts the edge position detected by the edge detector unit to an edge position at a position of the recording device. The controller adjusts the discharge position with an adjustment amount corresponding to the edge position at the position of the recording device converted by the edge position converter.

In the Aspect A, the discharge position is adjusted by the adjustment amount corresponding to the edge position at the position of the recording device converted by the edge position converter from the edge position at the position of the edge detector. With this structure, the discharge position of the line head unit 10 can be prevented from displacing laterally to a position shifted by the difference of the edge position between the position of the edge sensor 30 and the position of the line head unit 10. As a result, the discharge position of the recording device to discharge liquid droplets to the recording medium can be prevented from deviating from the target discharge position by the error amount in the recording medium width direction.

Aspect B:

In Aspect A, the edge detector includes an upstream edge detector such as an edge sensor 30C disposed upstream of the recording device in the recording medium conveyance direction, and a downstream edge detector such as an edge sensor 30M disposed downstream of the recording device in the recording medium conveyance direction. The edge position converter converts, based on an upstream edge position detected by the upstream edge detector and a downstream edge position detected by the downstream edge detector, the upstream edge position to an edge position at a position of the recording device. With this structure, even with the width direction change of the recording medium due to a wobbled skew, the discharge position can be more correctly adjusted.

Aspect C:

In Aspect B, the edge position converter converts the upstream edge position based on a skew amount between the upstream edge detector and the downstream edge detector obtained from the upstream edge position and the downstream edge position. With this structure, even with the width direction change of the recording medium due to a wobbled skew, the discharge position can be more correctly adjusted based on the skew amount.

Aspect D:

In Aspect B or C, the recording device discharge position adjustor further includes a recording medium feed device such as a feed roller 40 to convey the recording medium; a recording medium conveyance amount detector such as an encoder 50 to detect a conveyance amount of the recording medium by the recording medium feed device; an edge detection position phase matching device to detect a displacement amount of the same edge portion of the recording medium by the upstream edge detector and the downstream edge detector; a first noise canceller such as an LPF to eliminate noise from the detection results of the upstream edge detector and the downstream noise detector; an edge displacement amount detector to detect a displacement amount of the edge position between the upstream edge detector and the downstream edge detector based on a difference between the upstream edge position and the downstream edge position; and a second noise canceller such as an LPF to cancel noise from the edge displacement amount detector. Thus, the edge position at a position of the recording device can be detected more accurately as described in the aforementioned embodiments.

Aspect E:

In any of Aspects A, B, C or D, the discharge position adjustor is defined by a moving device such as an actuator 20 that moves the recording device laterally, and the adjustment amount is the displacement amount of the recording device by the moving device. With this structure, the recording device is displaced at a position where a target discharge position relative to the recording medium is obtained, and the discharge position can be more correctly adjusted.

Aspect F:

An image forming apparatus includes a plurality of recording devices, disposed along a recording medium conveyance direction, to discharge liquid droplets onto a recording medium to thereby record an image thereon; a plurality of edge detectors to detect an edge position of the recording medium in a width direction of the recording medium perpendicular to the recording medium conveyance direction; and a discharge position adjustor to adjust a discharge position of the liquid droplets toward the recording medium, of at least one of the recording devices, in which a recording device discharge position adjustor as described in any one of Aspects A to E is provided.

With this structure, relative positional errors of each of the recording devices relative to the recording medium can be reduced, thereby preventing image quality from degrading.

Additional modifications and variations of the present invention are possible in light of the above teachings. It is therefore to be understood that, within the scope of the appended claims, the invention may be practiced other than as specifically described herein.

What is claimed is:

1. A recording device discharge position adjustor comprising:

a recording device configured to discharge liquid droplets onto a recording medium;

an edge detector configured to detect a lateral edge position of the recording medium in a direction perpendicular to a recording medium conveyance direction prior to discharging the liquid droplets onto the recording medium, the edge detector including at least an upstream edge detector and a downstream edge detector configured to detect the recording medium at an upstream edge position that is upstream of the recording device and detect the recording medium at a downstream edge position that is downstream of the recording device, respectively, prior to discharging the liquid droplets onto the recording medium;

a discharge position adjustor configured to adjust a discharge position of the liquid droplets from the recording device relative to the recording medium;

a memory configured to store distance information, the distance information including a distance between the upstream edge detector and the recording device and a distance between the upstream edge detector and the downstream edge detector; and a controller configured to, convert the lateral edge position of the recording medium detected by edge detector to a converted edge position at a position of the recording device based on the upstream edge position, the downstream edge position and the distance information by, subtracting the upstream edge position from the downstream edge position to determine a first variable, dividing the distance between the upstream edge detector and the recording device by the distance between the upstream edge detector and the downstream edge detector to determine a second variable, and multiplying the first variable by the second variable to determine the converted edge position; and adjust the discharge position by instructing the discharge position adjustor to move the recording device laterally an adjustment amount prior to discharging the liquid droplets onto the recording medium, the adjustment amount corresponding to the converted edge position of the recording medium at the position of the recording device.

2. The recording device discharge position adjustor as claimed in claim 1, wherein the controller is configured to convert the upstream edge position based on a skew amount between the upstream edge detector and the downstream edge detector obtained at the upstream edge position and the downstream edge position, respectively.

3. The recording device discharge position adjustor as claimed in claim 1, further comprising:

a recording medium feed device configured to convey the recording medium;

a recording medium conveyance amount detector configured to detect a conveyance amount of the recording medium by the recording medium feed device;

an edge detection position phase matching device configured to detect a first displacement amount of an identical edge position of the recording medium between the upstream edge detector and the downstream edge detector based on the conveyance amount of the recording medium;

a first noise canceller configured to cancel noise from the upstream edge detector and the downstream edge detector based on the first displacement amount;

an edge displacement amount detector configured to detect a second displacement amount of the identical edge position of the recording medium between the upstream edge detector and the downstream edge detector based on a difference between the upstream edge position and the downstream edge position; and a second noise canceller configured to cancel noise from the edge displacement amount detector based on the second displacement amount.

4. The recording device discharge position adjustor as claimed in claim 1, wherein the discharge position adjustor comprises:

a moving device configured to move the recording device laterally the adjustment amount.

5. An image forming apparatus comprising:

a plurality of recording devices to discharge liquid droplets onto a recording medium to record an image on the recording medium, disposed along a recording medium conveyance direction;

a plurality of edge detectors to detect a lateral edge position of the recording medium in a direction perpendicular to the recording medium conveyance direction;

a discharge position adjustor to adjust a discharge position of the liquid droplets relative to the recording medium, from at least one of the recording devices; and the recording device discharge position adjustor as claimed in claim 1.

6. A line head position correction device comprising:

a line head device configured to discharge liquid droplets onto a recording medium to record an image on the recording medium;

an edge sensor configured to detect a lateral edge position of the recording medium in a direction perpendicular to a recording medium conveyance direction prior to discharging the liquid droplets onto the recording medium, the edge sensor including at least an upstream edge sensor and a downstream edge sensor configured to detect the recording medium at an upstream edge position that is upstream of the line head device and detect the recording medium at a downstream edge position that is downstream of the line head device, respectively;

an actuator configured to adjust a discharge position of the liquid droplets from the line head device relative to the recording medium;

a memory configured to store distance information, the distance information including a distance between the upstream edge sensor and the line head device and a distance between the upstream edge sensor and the downstream edge sensor; and a controller configured to, convert the lateral edge position of the recording medium detected by edge sensor to a converted edge position of the recording medium at a position of the line head device based on the upstream edge position, the downstream edge position and the distance information by, subtracting the upstream edge position from the downstream edge position to determine a first variable, dividing the distance between the upstream edge sensor and the line head device by the distance between the upstream edge sensor and the downstream edge sensor to determine a second variable, and multiplying the first variable by the second variable to determine the converted edge position; and adjust the discharge position by instructing the actuator to move the line head device laterally an adjustment amount prior to discharging the liquid droplets onto the recording medium, the adjustment amount corresponding to the converted edge position of the recording medium at the position of the line head device.

7. A recording device discharge position adjustor comprising:

a recording device configured to discharge liquid droplets onto a recording medium;

a lateral position detector configured to detect a lateral position of the recording medium in a direction perpendicular to a recording medium conveyance direction prior to discharging the liquid droplets onto the recording medium, the lateral position detector including at least an upstream detector and a downstream detector configured to detect the recording medium at an upstream lateral position that is upstream of the recording device and detect the recording medium at a downstream lateral position that is downstream of the recording device, respectively;

an actuator configured to adjust a discharge position of the liquid droplets from the recording device relative to the recording medium;

a memory configured to store distance information, the distance information including a distance between the upstream detector and the recording device and a distance between the upstream detector and the downstream detector;

a processor configured to, convert a detected lateral position of the recording medium detected by the lateral position detector to a converted lateral position at a position of the recording device based on the upstream lateral position, the downstream lateral position and the distance information by, subtracting the upstream lateral position from the downstream lateral position to determine a first variable, dividing the distance between the upstream detector and the recording device by the distance between the upstream detector and the downstream detector to determine a second variable, and multiplying the first variable by the second variable to determine the converted lateral position; and adjust the discharge position by instructing the actuator to move the recording device laterally an adjustment amount prior to discharging the liquid droplets onto the recording medium, the adjustment amount corresponding to the converted lateral position of the recording medium at the position of the recording device.

8. The recording device discharge position adjustor as claimed in claim 7, further comprising:

a moving device configured to move the recording device laterally the adjustment amount.

9. The recording device discharge position adjustor as claimed in claim 7, wherein the processor is configured to convert the upstream lateral position based on a skew amount between the upstream detector and the downstream detector obtained at the upstream lateral position and the downstream lateral position, respectively.

10. The recording device discharge position adjustor as claimed in claim 7, further comprising:

a recording medium feed device configured to convey the recording medium;

an encoder configured to detect a conveyance amount of the recording medium by the recording medium feed device;

an edge detection position phase matching device configured to detect a first displacement amount of an identical edge position of the recording medium between the upstream detector and the downstream detector based on the conveyance amount of the recording medium;

a first noise canceller configured to cancel noise from the upstream detector and the downstream detector based on the first displacement amount;

an edge displacement amount detector configured to detect a second displacement amount of the identical edge position of the recording medium between the upstream detector and the downstream detector based on a difference between the upstream lateral position and the downstream lateral position; and a second noise canceller configured to cancel noise from the edge displacement amount detector based on the second displacement amount.

11. The recording device discharge position adjustor as claimed in claim 10, wherein the first noise canceller and the second noise canceller are each low-pass filters (LPFs).

* * * * *